US010360865B2

(12) United States Patent
Kim et al.

(10) Patent No.: US 10,360,865 B2
(45) Date of Patent: Jul. 23, 2019

(54) GATE DRIVING CIRCUIT HAVING HIGH RELIABILITY AND DISPLAY DEVICE INCLUDING THE SAME

(71) Applicant: SAMSUNG DISPLAY CO., LTD., Yongin-si, Gyeonggi-do (KR)

(72) Inventors: Jonghee Kim, Yongin-si (KR); Kyoungseok Son, Seoul (KR); Kyoungju Shin, Hwaseong-si (KR)

(73) Assignee: Samsung Display Co., Ltd., Yongin-Si, Gyeonggi-do (KR)

( * ) Notice: Subject to any disclaimer, the term of this patent is extended or adjusted under 35 U.S.C. 154(b) by 59 days.

(21) Appl. No.: 15/463,012

(22) Filed: Mar. 20, 2017

(65) Prior Publication Data

US 2017/0270883 A1 Sep. 21, 2017

(30) Foreign Application Priority Data

Mar. 21, 2016 (KR) ..... 10-2016-0033598

(51) Int. Cl.
*G09G 3/36* (2006.01)

(52) U.S. Cl.
CPC ..... *G09G 3/3677* (2013.01); *G09G 3/3688* (2013.01); *G09G 2310/0289* (2013.01); *G09G 2310/0294* (2013.01); *G09G 2310/08* (2013.01)

(58) Field of Classification Search
CPC ..... G09G 3/3677; G09G 3/3688; G09G 2310/0294; G09G 2310/0289; G09G 2310/08
See application file for complete search history.

(56) References Cited

U.S. PATENT DOCUMENTS

2011/0122117 A1* 5/2011 Lee ..... G09G 3/3677 345/211
2015/0042689 A1* 2/2015 Kim ..... H03K 3/012 345/690
2015/0213746 A1 7/2015 Kim et al.
2015/0228353 A1* 8/2015 Qing ..... G11C 19/28 377/75

FOREIGN PATENT DOCUMENTS

CN 104575385 A * 4/2015 ..... G09G 3/3225
KR 10-2010-0077472 A 7/2010
KR 10-2011-0076450 A 7/2011
KR 10-2014-0024994 A 3/2014
(Continued)

*Primary Examiner* — Kwang-Su Yang
(74) *Attorney, Agent, or Firm* — Lee & Morse, P.C.

(57) ABSTRACT

A gate driving circuit includes a plurality of stages to provide gate signals to gate lines of a display panel. At least one of the stages includes an input circuit receiving a carry signal from a previous stage. A first output circuit outputs a first clock signal as a gate signal. The second output circuit outputs the clock signal as a carry signal. The discharge hold circuit delivers the clock signal to a node based on the clock signal and discharges the node as a second voltage based on the carry signal. The pull down circuit discharges the gate signal as a first voltage based on a signal of the node and a succeeding carry signal from a succeeding stage and discharges another node and the carry signal as the second voltage. The switching circuit delivers the carry signal from the previous stage based on a second clock signal.

15 Claims, 10 Drawing Sheets

(56) References Cited

FOREIGN PATENT DOCUMENTS

| | | | |
|---|---|---|---|
| KR | 10-2014-0051136 | A | 4/2014 |
| KR | 10-2015-0017810 | A | 2/2015 |
| KR | 10-2015-0031899 | A | 3/2015 |
| KR | 10-2015-0066981 | A | 6/2015 |
| KR | 10-2016-0087950 | A | 7/2015 |
| KR | 10-2016-0087950 | A | 7/2016 |
| KR | 10-2016-0089937 | A | 7/2016 |
| KR | 10-2017-0104050 | A | 9/2017 |
| KR | 10-2017-0115183 | A | 10/2017 |

* cited by examiner

GATE DRIVING CIRCUIT HAVING HIGH RELIABILITY AND DISPLAY DEVICE INCLUDING THE SAME

CROSS-REFERENCE TO RELATED APPLICATION

Korean Patent Application No. 10-2016-0033598, filed on Mar. 21, 2016, and entitled, "Gate Driving Circuit and Display Device Including the Same," is incorporated by reference herein in its entirety.

BACKGROUND

1. Field

One or more embodiments described herein relate to a gate driving circuit and a display device including a gate driving circuit.

2. Description of the Related Art

A display device includes a plurality of pixels connected to a plurality of gate lines and a plurality of data lines. A gate driving circuit sequentially provides gate signals to the gate lines. A data driving circuit outputs data signals to the data lines. The gate driving circuit includes a shift register with a plurality of driving stages. The driving stages respectively output gate signals corresponding to the gate lines. Each of the driving stages includes a plurality of organically-connected transistors.

SUMMARY

In accordance with one or more embodiments, a gate driving circuit includes a plurality of stages to provide gate signals to gate lines of a display panel, wherein a k-th stage (k being a natural number greater than or equal to 2) of the plurality of stages includes: an input circuit to receive a (k−1)th carry signal from a (k−1)th stage; a first output circuit to output a first clock signal as a k-th gate signal based on a signal of a first node; a second output circuit to output the clock signal as a k-th carry signal based on the signal of the first node; a discharge hold circuit to deliver the clock signal to a second node based on the clock signal and discharge the second node as a second voltage based on the k-th carry signal; a pull down circuit to discharge the k-th gate signal as a first voltage based on a signal of the second node and a (k+1)th carry signal from a (k+1)th stage and discharge the first node and the k-th carry signal as the second voltage; and a switching circuit, connected between the input circuit and the first node, to deliver the (k−1)th carry signal received through the input circuit to the first node based on a second clock signal.

The first and second clock signals may have different phases. The switching circuit may include a switching transistor with a first electrode connected to the input circuit, a second electrode connected to the first node, and a control electrode connected to a second clock terminal to receive the second clock signal. The input circuit may include an input transistor including a first electrode connected to a first input terminal for receiving the (k−1)th carry signal, a second electrode connected to the first electrode of the switching transistor, and a control electrode connected to the first input terminal.

The discharge hold circuit may include a first hold transistor with a first electrode connected to a first clock terminal to receive the first clock signal, a second electrode, and a gate electrode connected to the first clock terminal; a second hold transistor with a first electrode connected to the first clock terminal, a second electrode connected to the second node, and a gate electrode connected to the second electrode of the first hold transistor; a third hold transistor with a first electrode connected to the second electrode of the first hold transistor, a second electrode connected to a second terminal to receive the second voltage, and a gate electrode connected to a carry output terminal to output the k-th carry signal; and a fourth hold transistor with a first electrode connected to the second node, a second electrode connected to the second terminal, and a gate electrode connected to the carry output terminal.

In accordance with one or more other embodiments, a gate driving circuit includes a plurality of stages including a k-th stage (k is a positive integer greater than 1), the k-th stage including: an input circuit to receive a (k−1)th carry signal from a (k−1)th stage; a first output circuit to output a first clock signal as a k-th gate signal based on a signal of a first node; a second output circuit to output the clock signal as a k-th carry signal based on the signal of the first node; a discharge hold circuit to deliver the clock signal to a second node based on the clock signal and discharge the second node as a second voltage based on the k-th carry signal; a pull down circuit to discharge the k-th gate signal as a first voltage based on a signal of the second node and a (k+1)th carry signal from a (k+1)th stage and discharge the first node and the k-th carry signal as the second voltage; a switching circuit, connected between the input circuit and the first node, to deliver the (k−1)th carry signal received through the input circuit to the first node based on a second clock signal; and a carry feedback circuit to feed back the k-th carry signal as the (k−1)th carry signal.

The first and second clock signals may have different phases. The switching circuit may include a switching transistor with a first electrode connected to the input circuit, a second electrode connected to the first node, and a control electrode connected to a second clock terminal to receive the second clock signal. The input circuit may include an input transistor with a first electrode connected to a first input terminal to receive the (k−1)th carry signal, a second electrode connected to the first electrode of the switching transistor, and a control electrode connected to the first input terminal. The carry feedback circuit may include a first electrode connected to a carry output terminal to output the k-th carry signal, a second electrode connected to a first input terminal to receive the (k−1)th carry signal, and a gate electrode connected to the carry output terminal.

The carry feedback circuit may feed back the k-th carry signal to a connection node of the input circuit and the switching circuit. The carry feedback circuit may include a first feedback transistor with a first electrode connected to a carry output terminal to output the k-th carry signal, a second electrode connected to a first input terminal to receive the (k−1)th carry signal, and a gate electrode connected to the carry output terminal; and a second feedback transistor with a first electrode connected to the carry output terminal, a second electrode connected to a connection node of the input circuit and the switching circuit, and a gate electrode connected to the carry output terminal.

In accordance with one or more other embodiments, a display device includes a display panel including a plurality of pixels connected to a plurality of gate lines and a plurality of data lines, respectively; a gate driving circuit including a plurality of stages to output gate signals to the plurality of gate lines; and a data driving circuit to drive the plurality of data lines, wherein a k-th stage (k is a positive integer greater than 1) among the plurality of stages in the gate driving circuit includes: an input circuit to receive a (k−1)th carry signal from a (k−1)th stage; a first output circuit to output a first clock signal as a k-th gate signal based on a signal of a first node; a second output circuit to output the clock signal as a k-th carry signal based on the signal of the first node; a discharge hold circuit to deliver the clock signal to a second node based on the clock signal and discharge the second node as a second voltage based on the k-th carry signal; a pull down circuit to discharge the k-th gate signal as a first voltage based on a signal of the second node and a (k+1)th carry signal from a (k+1)th stage and to discharge the first node and the k-th carry signal as the second voltage; and a switching circuit, connected between the input circuit and the first node, to deliver the (k−1)th carry signal received through the input circuit to the first node based on a second clock signal.

The first and second clock signals may have different phases. The switching circuit may include a switching transistor including a first electrode connected to the input circuit, a second electrode connected to the first node, and a control electrode connected to a second clock terminal to receive the second clock signal.

In accordance with one or more other embodiments, a display device includes a display panel including a plurality of pixels connected to a plurality of gate lines and a plurality of data lines, respectively; a gate driving circuit including a plurality of stages to output gate signals to the plurality of gate lines; and a data driving circuit to drive the plurality of data lines, wherein a k-th stage (k is a positive integer greater than 1) among the plurality of stages includes: an input circuit to receive a (k−1)th carry signal from a (k−1)th stage; a first output circuit to output a first clock signal as a k-th gate signal based on a signal of a first node; a second output circuit to output the clock signal as a k-th carry signal based on the signal of the first node; a discharge hold circuit to deliver the clock signal to a second node based on the clock signal and discharge the second node as a second voltage based on the k-th carry signal; a pull down circuit to discharge the k-th gate signal as a first voltage based on a signal of the second node and a (k+1)th carry signal from a (k+1)th stage and to discharge the first node and the k-th carry signal as the second voltage; a switching circuit, connected between the input circuit and the first node, to deliver the (k−1)th carry signal received through the input circuit to the first node based on a second clock signal; and a carry feedback circuit to feed back the k-th carry signal as the (k−1)th carry signal.

The first and second clock signals may have different phases. The switching circuit may include a switching transistor including a first electrode connected to the input circuit, a second electrode connected to the first node, and a control electrode connected to a second clock terminal to receive the second clock signal. The carry feedback circuit may include a first electrode connected to a carry output terminal to output the k-th carry signal, a second electrode connected to a first input terminal for receiving the (k−1)th carry signal, and a gate electrode connected to the carry output terminal.

The carry feedback circuit may include a first feedback transistor includes a first electrode connected to a carry output terminal to output the k-th carry signal, a second electrode connected to a first input terminal to receive the (k−1)th carry signal, and a gate electrode connected to the carry output terminal; and a second feedback transistor includes a first electrode connected to the carry output terminal, a second electrode connected to a connection node of the input circuit and the switching circuit, and a gate electrode connected to the carry output terminal.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
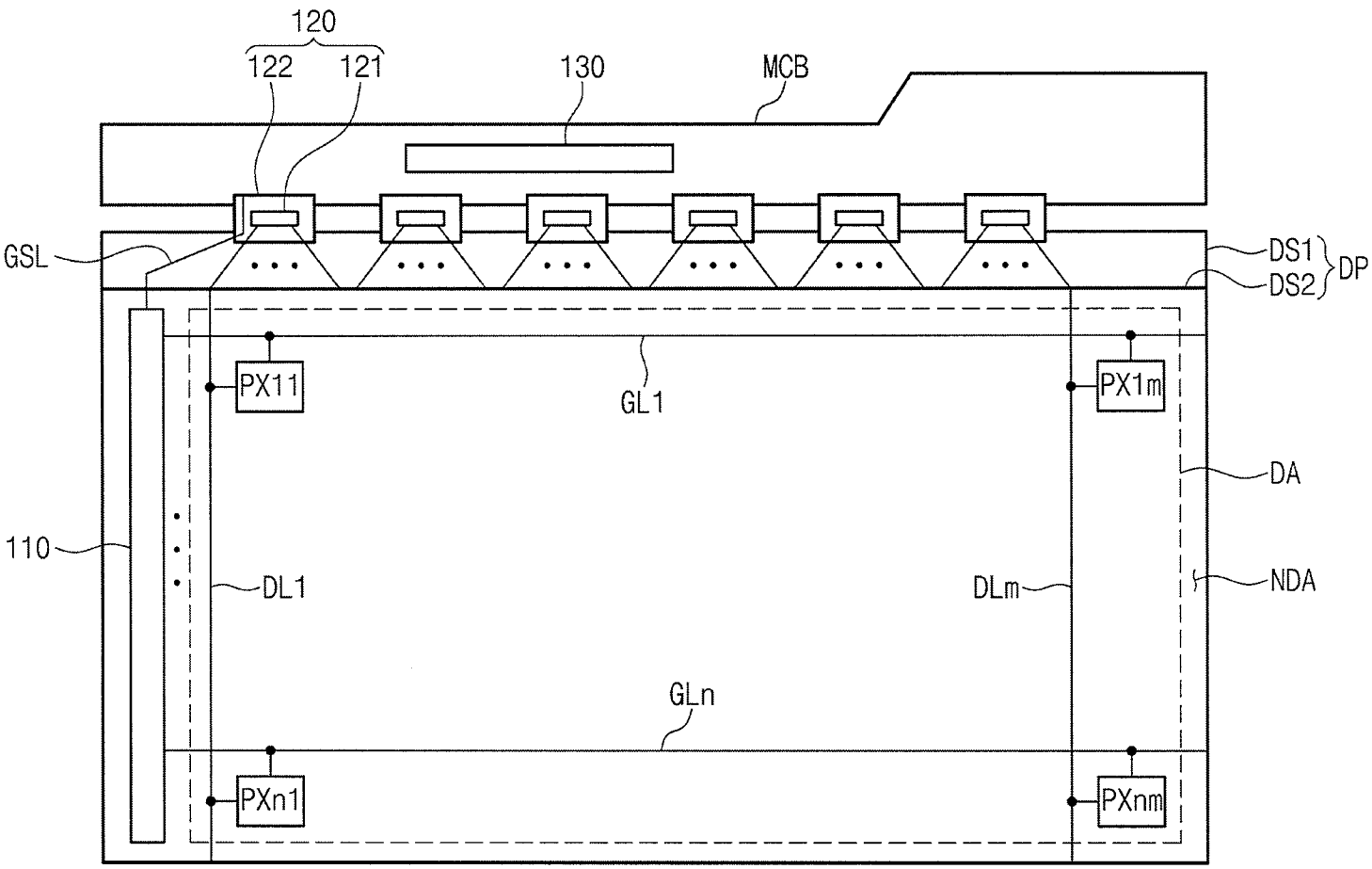
FIG. 1 illustrates an embodiment of a display device.

Example embodiments are described hereinafter with reference to the drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments (or portions thereof) may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

Figure 2:
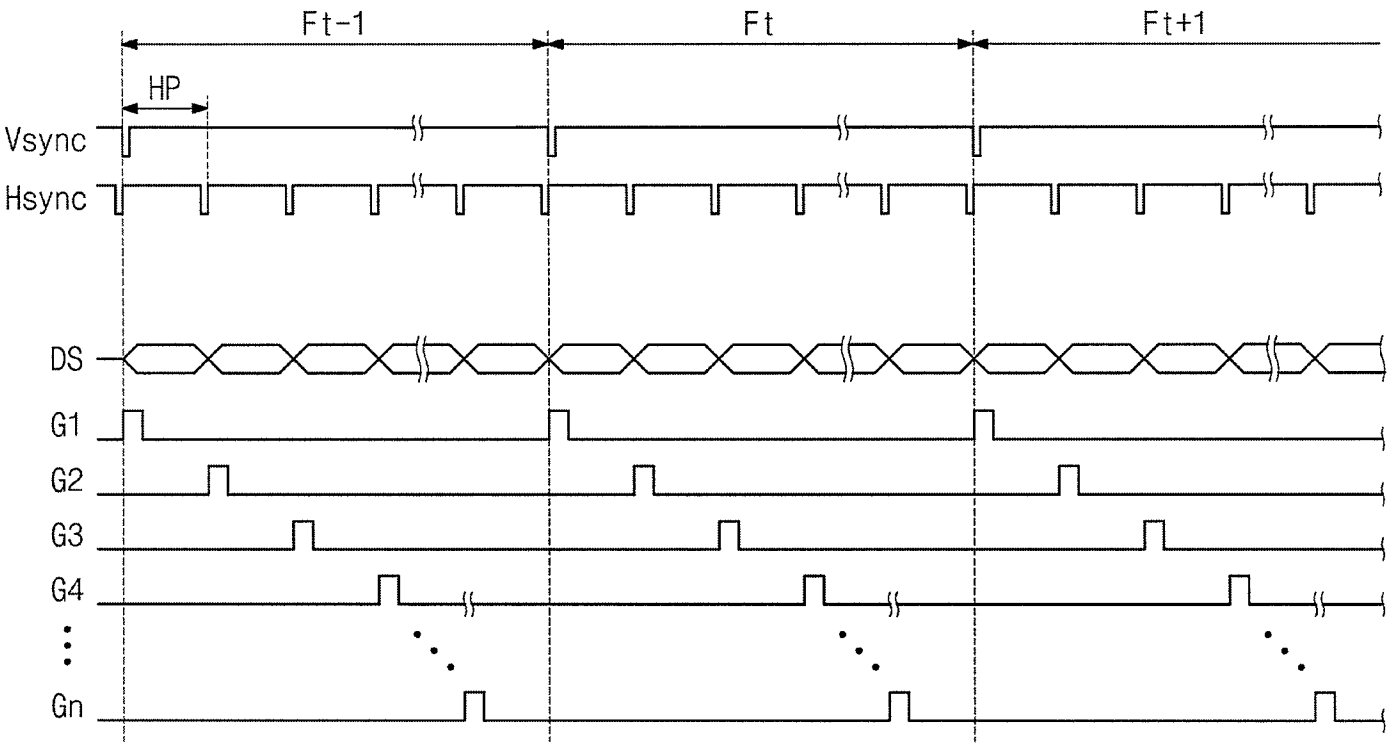
FIG. 2 illustrates an embodiment of signals for the display device.

FIG. 1 illustrates an embodiment of a display device, and FIG. 2 illustrates an embodiment of a timing diagram of signals for the display device. Referring to FIGS. 1 and 2, the display device includes a display panel DP, a gate driving circuit 110, a data driving circuit 120, and a driving controller 130. The display panel DP may be, for example, a liquid crystal display panel, an organic light emitting display panel, an electrophoretic display panel, or an electrowetting display panel. For illustrative purposes, the display panel DP is discussed as a liquid crystal display panel, which, for example, may include a polarizer and a backlight unit.

The display panel DP includes a first substrate DS1, a second substrate DS2 spaced apart from the first substrate DS1, and a liquid crystal layer LCL disposed between the first substrate DS1 and the second substrate DS2. On a plane, the display panel DP includes a display area DA where a plurality of pixels PX11 to PXnm and a non-display area NDA surrounding the display area DA.

The display panel DP includes a plurality of gate lines GL1 to GLn on the first substrate DS1 and a plurality of data lines DL1 to DLm intersecting the gate lines GL1 to GLn. The gate lines GL1 to GLn are connected to the gate driving circuit 110. The data lines DL1 to DLm are connected to the data driving circuit 120. Only some of the gate lines GL1 to GLn and only some of the data lines DL1 to DLm are illustrated in FIG. 1.

Only some of the pixels PX11 to PXnm are illustrated in FIG. 1. The pixels PX11 to PXnm are respectively connected to corresponding ones of the gate lines GL1 to GLn and corresponding ones of the data lines DL1 to DLm. The pixels PX11 to PXnm may be divided into a plurality of groups according to a color of light to be displayed. The pixels PX11 to PXnm may display one of primary colors. The primary colors may include, for example, red, green, blue, and white. In one embodiment, the primary colors may be different colors, e.g., yellow, cyan, magenta.

The gate driving circuit 110 and the data driving circuit 120 receive control signals from the driving controller 130. The driving controller 130 may be on a main circuit board MCB. The driving controller 130 receives image data and control signals from an external graphic control unit. The control signals may include vertical sync signals Vsync for distinguishing frame sections Ft−1, Ft, and Ft+1, horizontal sync signals Hsync for distinguishing horizontal sections HP (e.g., row distinction signals), and data enable signals (e.g., that are in high level only during a section where data is outputted to display a data incoming area), and clock signals.

The gate driving circuit 110 generates gate signals G1 to Gn based on control signals (e.g., gate control signals) from the driving controller 130 through signal lines GSL. The gate signals G1 to Gn are output to the gate lines GL1 to GLn during the frame sections Ft−1, Ft, and Ft+1. The gate signals G1 to Gn may be sequentially output in correspondence to the horizontal sections HP. The gate driving circuit 110 and the pixels PX11 to PXnm may be formed, for example, simultaneously through a thin film process. The gate driving circuit 110 may be, for example, an Oxide Semiconductor TFT Gate driver circuit (OSG) in the non-display area NDA.

One gate driving circuit 110 is connected to left ends of the gate lines GL1 to GLn in FIG. 1 as a example. According to an embodiment, a display device may include two gate driving circuits. One of the two gate driving circuits may be connected to left ends of the gate lines GL1 to GLn and the other one may be connected to right ends of the gate lines GL1 to GLn. Additionally, in one embodiment, one of the two gate driving circuits may be connected to odd gate lines and the other one may be connected to even gate lines.

The data driving circuit 120 generates grayscale voltages according to image data from the driving controller 130 based on control signals (e.g., data control signals) from the driving controller 130. The data driving circuit 120 outputs the grayscale voltages as data voltages DS to the data lines DL1 to DLm.

The data voltages DS may include positive data voltages having a positive value with respect to a common voltage and/or negative data voltages having a negative value with respect to the common voltage. Some of data voltages applied to the data lines DL1 to DLm have a positive polarity and other data voltages have a negative polarity during each of the horizontal sections HP. The polarity of the data voltages DS may be inverted according to the frame sections Ft−1, Ft, and Ft+1 in order to prevent deterioration of liquid crystals. The data driving circuit 120 may generate data voltages inverted by each frame section unit based on an invert signal.

The data driving circuit 120 may include a driving chip 121 and a flexible circuit board 122 on which the driving chip 121 is mounted. In one embodiment, the data driving circuit 120 may include a plurality of driving chips 121 and the flexible circuit board 122. The flexible circuit board 122 electrically connects the main circuit board MCB to the first substrate DS1. The driving chips 121 provide data signals for corresponding ones of the data lines DL1 to DLm.

A Tape Carrier Package (TCP) type of data driving circuit 120 is illustrated as an example in FIG. 1. According to another embodiment, the data driving circuit 120 may be mounted on the non-display area NDA of the first substrate DS1 using another method, e.g., a Chip-on-Glass (COG) method.

Figure 3:
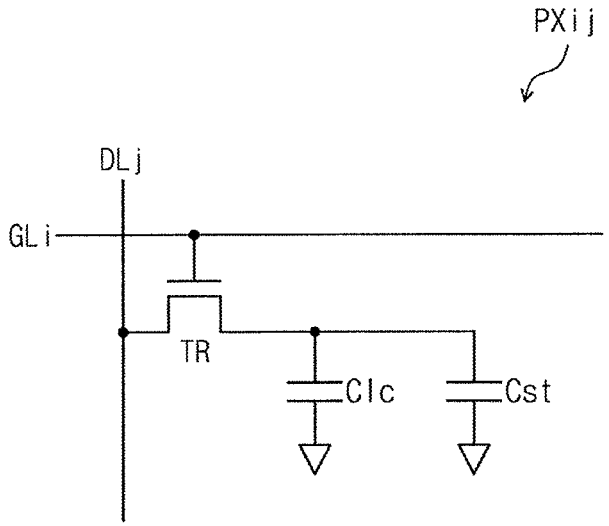
FIG. 3 illustrates an embodiment of a pixel.
Figure 4:
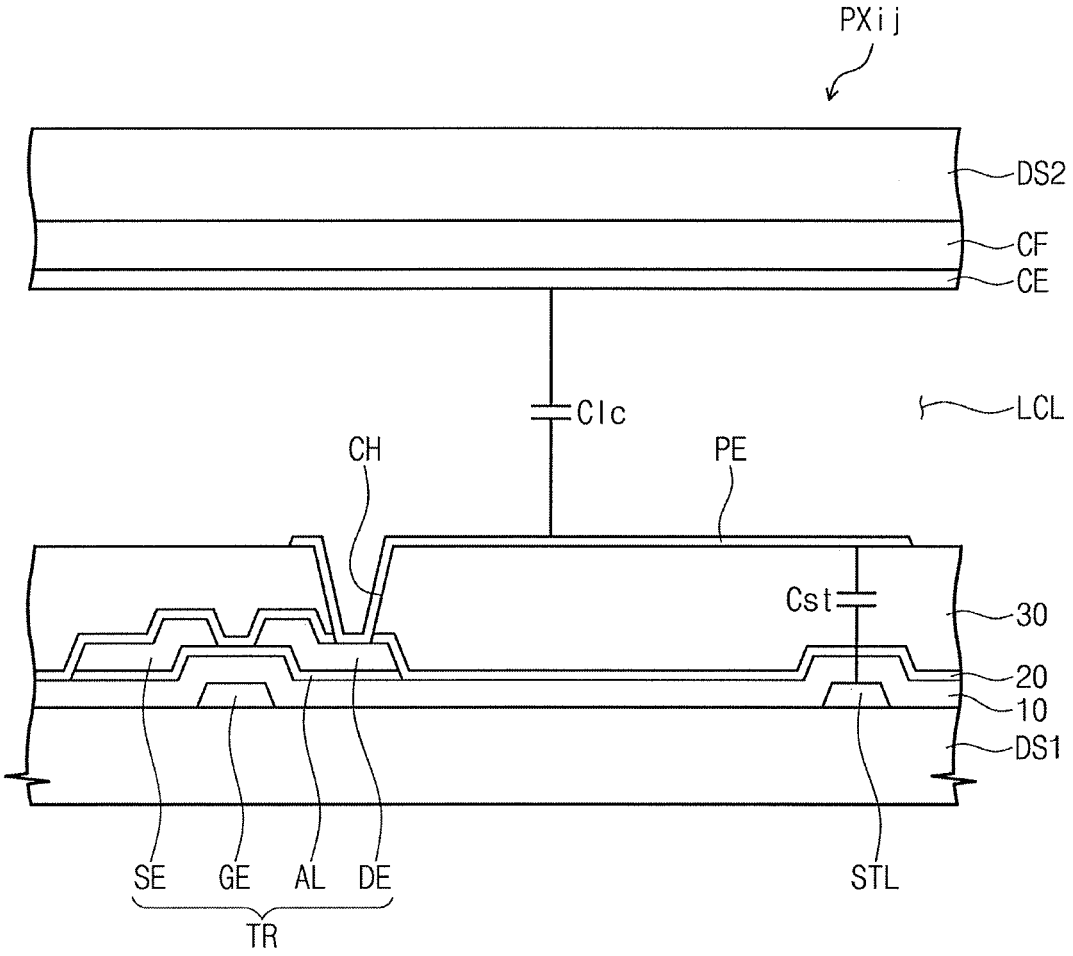
FIG. 4 illustrates a sectional view of a pixel according to one embodiment.

FIG. 3 illustrates an embodiment of a pixel. FIG. 4 illustrates an embodiment of a sectional view of the pixel. Each of the pixels PX11 to PXnm in FIG. 1 may have a structure as illustrated in FIG. 3.

Referring to FIG. 3, the PXij includes a pixel transistor (e.g., a thin film transistor) TR, a liquid crystal capacitor Clc, and a storage capacitor Cst. The pixel transistor TR is electrically connected to an ith gate line GLi and a jth data line DLj, and outputs a pixel voltage corresponding to a data signal from the jth data line DLj based on a gate signal from the ith gate line GLi.

The liquid crystal capacitor Clc is charged with a pixel voltage output from the pixel transistor TR. An arrangement of liquid crystal molecules in a liquid crystal layer LCL (e.g., see FIG. 4) is changed according to a charge amount charged in the liquid crystal capacitor CLC. The light incident to a liquid crystal layer may be transmitted or blocked according to an arrangement of liquid crystal directors.

The storage capacitor Cst is connected in parallel to the liquid crystal capacitor Clc and maintains an arrangement of liquid crystal directors during a predetermined section. In one embodiment, the storage capacitor Cst may be omitted.

As shown in FIG. 4, the pixel transistor TR includes a control electrode GE connected to the ith gate line GLi, an activation part AL overlapping the control electrode GE, a first electrode SE connected to the jth data line DLj (e.g., see FIG. 3), and a second electrode DE disposed spaced apart from the first electrode SE.

The liquid crystal capacitor Clc includes a pixel electrode PE and a common electrode CE. The storage capacitor Cst includes the pixel electrode PE and a portion of a storage line STL overlapping the pixel electrode PE.

The ith gate line GLi and the storage line STL are on one surface of the first substrate DS1. The control electrode GE is branched from the ith gate line GLi. The ith gate line GLi and the storage line STL may include a metal (e.g., Al, Ag, Cu, Mo, Cr, Ta, Ti, or an alloy thereof). The ith gate line GLi and the storage line STL may have a multi layer structure which includes, for example, a Ti layer and a Cu layer.

A first insulating layer 10 covering the control electrode GE and the storage line STL is on one surface of the first substrate DS1. The first insulating layer 10 may include at least one of an inorganic material or an organic material. The first insulating layer 10 may be an organic layer or an inorganic layer. The first insulating layer 10 may have a multi layer structure including, for example, a silicon nitride layer and a silicon oxide layer.

The activation part AL overlapping the control electrode GE is on the first insulating layer 10. The activation part AL may include a semiconductor layer and an ohmic contact layer. The semiconductor layer is disposed on the first insulating layer 10 and the ohmic contact layer is on the semiconductor layer.

The second electrode DE and the first electrode SE are on the activation part AL. The second electrode DE and the first electrode SE are spaced apart from each other. Each of the second electrode DE and the first electrode SE overlaps the control electrode GE at least partially.

A second insulating layer 20 covering the activation part AL, the second electrode DE, and the first electrode SE is on the first insulating layer 10. The second insulating layer 20 may include at least one of an inorganic material or an organic material. The second insulating layer 20 may be an organic layer or an inorganic layer. The second insulating layer 20 may have a multi layer structure including, for example, a silicon nitride layer and a silicon oxide layer.

The pixel transistor TR has a staggered structure in FIG. 1. In another embodiment, the structure of the pixel transistor TR may be different, e.g., a planar structure.

A third insulation layer 30 is on the second insulation layer 20 and provides a flat surface. The third insulating layer 30 may include an organic material.

The pixel electrode PE is on the third insulating layer 30. The pixel electrode PE is connected to the second electrode DE through a contact hole C11 penetrating the second insulating layer 20 and the third insulating layer 30. An alignment layer covering the pixel electrode PE may be on the third insulating layer 30.

A color filter layer CF is on one surface of the second substrate DS2. A common electrode CE is on the color filter layer CF. A common voltage is applied to the common electrode CE. A common voltage and a pixel voltage have different values. An alignment layer covering the common electrode CE may be on the common electrode CE. Another insulating layer may be between the color filter layer CF and the common electrode CE.

The pixel electrode PE and the common electrode CE with the liquid crystal layer LCL therebetween form the liquid crystal capacitor Clc. Additionally, portions of the pixel electrode PE and the storage line STL (with first insulating layer 10, the second insulating layer 20, and the third insulating layer 30 therebetween) form the storage capacitor Cst. The storage line STL receives a storage voltage different from a pixel voltage. In one embodiment, the storage voltage may be equal to a common voltage.

A section of the pixel PXij in FIG. 3 is just one example. In one embodiment, at least one of the color filter layer CF or the common electrode CE may be on the first substrate DS1. A liquid display panel may therefore include a pixel in a Vertical Alignment (VA) mode, a Patterned Vertical Alignment (PVA) mode, an in-plane switching (IPS) mode, a fringe-field switching (FFS) mode, or a Plane to Line Switching (PLS) mode.

Figure 5:
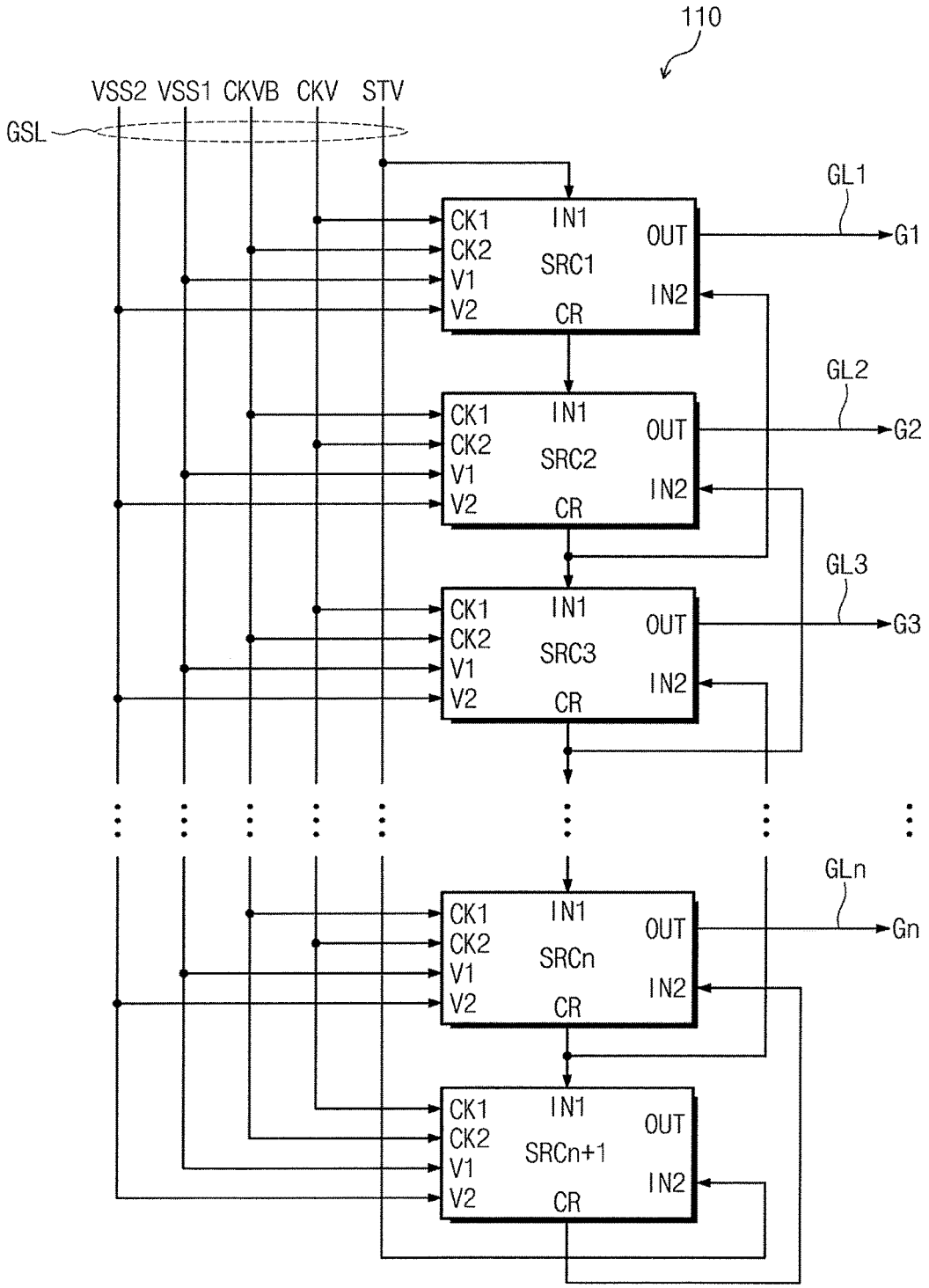
FIG. 5 illustrates an embodiment of a gate driving circuit.

FIG. 5 illustrates an embodiment of the gate driving circuit 110 which includes a plurality of driving stages SRC1 to SRCn and a dummy driving stage SRCn+1. The driving stages SRC1 to SRCn and the dummy driving stage SRCn+1 have a cascade relationship and operate based on a carry signal output from a previous stage and a carry signal output from the next stage.

Each of the driving stages SRC1 to SRCn receives a first clock signal CKV, a second clock signal CKVB, a first ground voltage VSS1, and a second ground voltage VSS2 from the driving controller 130 as in FIG. 1. The driving stage SRC1 and the dummy driving stage SRCn+1 also receive a start signal STV.

According to this embodiment, the driving stages SRC1 to SRCn are respectively connected to the gate lines GL1 to GLn. The driving stages SRC1 to SRCn respectively provide gate signals G1 to Gn to the gate lines GL1 to GLn. According to an embodiment, gate lines connected to the driving stages SRC1 to SRCn may be odd gate lines or even gate lines among the entire gate lines.

Each of the driving stages SRC1 to SRCn and the dummy driving stage SRCn+1 includes a first input terminal IN1, a second input terminal IN2, a gate output terminal OUT, a carry output terminal CR, a clock terminal CK1, a second clock terminal CK2, a first ground terminal V1, and a second ground terminal V2.

The gate output terminal OUT of each of the driving stages SRC1 to SRCn is connected to a corresponding one of the gate lines GL1 to GLn. Gate signals generated from the driving stages SRC1 to SRCn are provided to the gate lines GL1 to GLn through corresponding gate output terminals OUT.

The carry output terminal CR of each of the driving stages SRC1 to SRCn is electrically connected to the first input terminal IN1 of the next driving stage of a corresponding driving stage. Additionally, the carry output terminal CR of each of the driving stages SRC2 to SRCn is electrically connected to the second input terminal IN2 of a previous driving stage. For example, the carry output terminal CR of the k-th driving stage among the driving stages SRC1 to SRCn is connected to the second input terminal IN2 of the (k−1)th driving stage and the first input terminal IN1 of the (k+1)th driving stage. The carry output terminal CR of each of the driving stages SRC1 to SRCn and the dummy driving stage SRCn+1 outputs a carry signal.

The first input terminal IN1 of each of the driving stages SRC2 to SRCn and the dummy driving stage SRCn+1 receives a carry signal of a previous driving stage of a corresponding driving stage. For example, the first input terminal IN1 of the k-th driving stage SRCk receives the carry signal CRk−1 of the (k−1)th driving stage SRCk−1. The first input terminal IN1 of the first driving stage SRC1 among the plurality of driving stages SRC1 to SRCn receives a vertical start signal STV from the driving controller 130 in FIG. 1, instead of the carry signal of a previous driving stage.

The second input terminal IN2 of each of the driving stages SRC1 to SRCn receives a carry signal from the carry output terminal CR of the next driving stage of a corresponding driving stage. For example, the second input terminal IN2 of the k-th driving stage SRCk receives a carry signal CRk+1 output from the carry output terminal CR of the (k+1)th driving stage SRCk+1. According to another embodiment, the second input terminal IN2 of each of the driving stages SRC1 to SRCn may be electrically connected to the gate output terminal OUT of the next driving stage of a corresponding driving stage. The second input terminal IN2 of the driving stage SRCn receives a carry signal CRn+1 output from the carry output terminal CR of the dummy driving stage SRCn+1.

The first clock terminal CK1 of each of the driving stages SRC1 to SRCn receives the first clock signal CKV and the second clock terminal CK2 receives the second clock signal CKVB. The first clock signal CKV and the second clock signal CKVB may have different phases. In one embodiment, the first clock signal CKV and the second clock signal CKVB may have opposite phases.

The first ground terminal V1 of each of the driving stages SRC1 to SRCn receives a first ground voltage VSS1. The second ground terminal V2 of each of the driving stages SRC1 to SRCn receives a second ground voltage VSS2. The first ground voltage VSS1 and the second ground voltage VSS2 have different voltage levels. The second ground voltage VSS2 may have a lower voltage level than the first ground voltage VSS1.

According to an embodiment, each of the driving stages SRC1 to SRCn may omit one of the first input terminal IN1, the second input terminal IN2, the gate output terminal OUT, the carry output terminal CR, the first ground terminal V1, and the second ground terminal V2, or may include additional terminals. For example, one of the first ground terminal V1 or the second ground terminal V2 may be omitted. In this case, each of the driving stages SRC1 to SRCn receive only one of the first ground voltage VSS1 or the second ground voltage VSS2. Additionally, the connection relationship of the driving stages SRC1 to SRCn may be changed.

Figure 6:
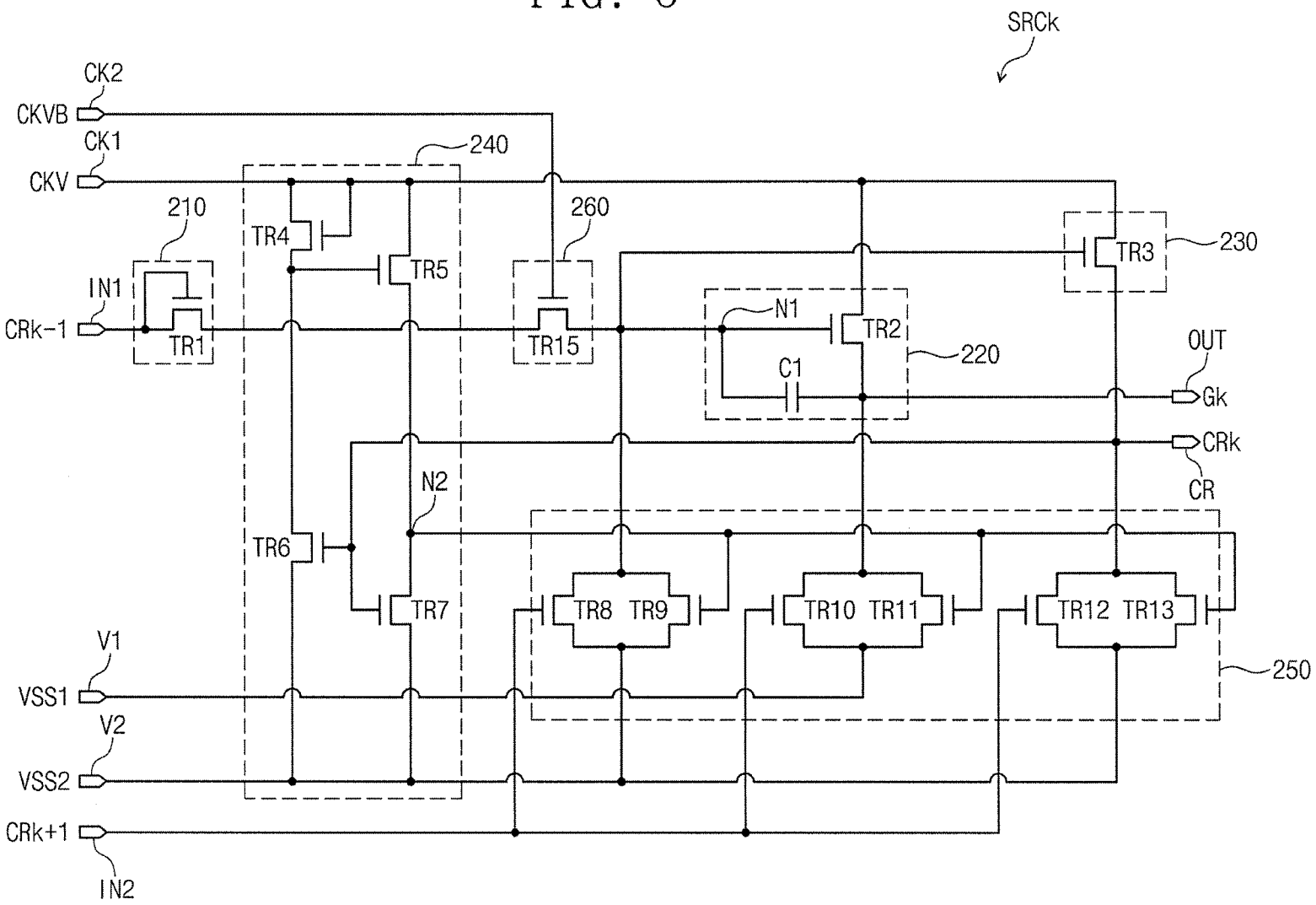
FIG. 6 illustrates an embodiment of a driving stage.

FIG. 6 illustrates an embodiment of the k-th driving stage SRCk (k is a positive integer greater than 1) among the driving stages SRC1 to SRCn in FIG. 5. Each of the driving stages SRC1 to SRCn in FIG. 5 may have the same circuit as the k-th driving stage SRCk. A k-th driving stage SRCk in FIG. 6 may receive a first clock signal CKV through a first clock terminal CK1 and may receive a second clock signal CKVb through a second clock terminal CK2. In one embodiment, the k-th driving stage SRCk may receive the second clock signal CKVB through the first clock terminal CK1 and may receive the first clock signal CKV through the second clock terminal CK2.

Referring to FIG. 6, the k-th driving stage SRCk includes an input circuit 210, a first output circuit 220, a second output circuit 230, a discharge hold circuit 240, a pull down circuit 250, and a switching circuit 260. The input circuit 210 receives a (k−1)th carry signal CRk−1 from a (k−1)th stage SRCk−1. The switching circuit 260 delivers a (k−1)th carry signal CRk−1 received through the input circuit 210 to a first node N1.

The first output circuit 220 outputs a clock signal CKV as a k-th carry signal Gk based on a signal of the first node N1. The second output circuit 230 outputs the clock signal CKV as the k-th carry signal CRk based on a signal of the first node N1.

The discharge hold circuit 240 delivers the first clock signal CKV to the second node N2 based on the first clock signal CKV and discharges the second node N2 as the second ground voltage VSS2 based on the k-th carry signal CRk.

The first pull down circuit 250 discharges the k-th gate signal Gk as the first ground voltage VSS1 and discharges the first node N1 and the k-th carry signal CRk as the second ground voltage VSS2 based on a signal of the second node N2 and the (k+1)th carry signal CRk+1 from the (k+1)th stage SRCk+1.

A specific example of the input circuit 210, the first output circuit 220, the second output circuit 230, the discharge hold circuit 240, the pull down circuit 250, and the switching circuit 260 is as follows. The input circuit 210 includes an input transistor TR1 having a first electrode connected to a first input terminal IN1 for receiving the (k−1)th carry signal CRk−1 from the (k−1)th stage SRCk−1, a second electrode, and a gate electrode connected to the first input terminal IN1.

The switching circuit 260 includes a switching transistor TR15 having a first electrode connected to the second electrode of the input transistor TR1, a second electrode connected to the first node N1, and a control electrode connected to a second clock terminal CK2 for receiving a second clock signal CKVB.

The first output circuit 220 includes a first output transistor TR2 and a capacitor C1. The first output transistor TR2 includes a first electrode connected to the first clock terminal CK1 for receiving the first clock signal CKV, a second electrode connected to a gate output terminal OUT for outputting the k-th gate signal Gk, and a gate electrode connected to the first node N1. The capacitor C1 is connected between the first node N1 and the gate output terminal OUT.

The second output circuit 230 includes a second output transistor TR3 having a first electrode connected to the first clock terminal CK1, a second electrode connected to a carry output terminal CR for outputting a k-th carry signal CRk, and a gate electrode connected to the first node N1.

The discharge hold circuit 240 includes first to fourth hold transistors TR4, TR5, TR6, and TR7. The first hold transistor TR4 includes a first electrode connected to the first clock terminal CK1, a second electrode, and a gate electrode connected to the first clock terminal CK1. The second hold transistor TR5 includes a first electrode connected to the first clock terminal CK1, a second electrode connected to the second node N2, and a gate electrode connected to the second electrode of the first hold transistor TR4. The third hold transistor TR6 includes a first electrode connected to the second electrode of the first hold transistor TR4, a second electrode connected to the second ground terminal V2 for receiving the second ground voltage VSS2, and a gate electrode connected to the carry output terminal CR for outputting the k-th carry signal CRk. The fourth hold transistor TR7 includes a first electrode connected to the second node N2, a second electrode connected to the second ground terminal V2, and a gate electrode connected to the carry output terminal CR.

The pull down circuit 250 includes first to sixth pull down transistors TR8, TR9, TR10, TR11, TR12, and TR13. The first pull down transistor TR8 includes a first electrode connected to the first node N1, a second electrode connected to the second ground terminal V2, and a gate electrode connected to the second input terminal IN2 for receiving the (k+1)th carry signal CRk+1 from the (k+1)th stage SRCk+1. The second pull down transistor T9 includes a first electrode connected to the first node N1, a second electrode connected to the second ground terminal V2, and a gate electrode connected to the second node N2. The third pull down transistor TR10 includes a first electrode connected to the gate output terminal OUT, a second electrode connected to the first ground terminal V1 for receiving the first ground voltage VSS1, and a gate electrode connected to the second input terminal IN2. The fourth pull down transistor TR11 includes a first electrode connected to the gate output terminal OUT, a second electrode connected to the first ground terminal V1, and a gate electrode connected to the second node N2. The fifth pull down transistor TR12 includes a first electrode connected to the carry output terminal CR, a second electrode connected to the second ground terminal V2, and a gate electrode connected to the second input terminal IN2. The sixth pull down transistor TR13 includes a first electrode connected to the carry output terminal CR, a second electrode connected to the second ground terminal V2, and a gate electrode connected to the second node N2.

Figure 7:
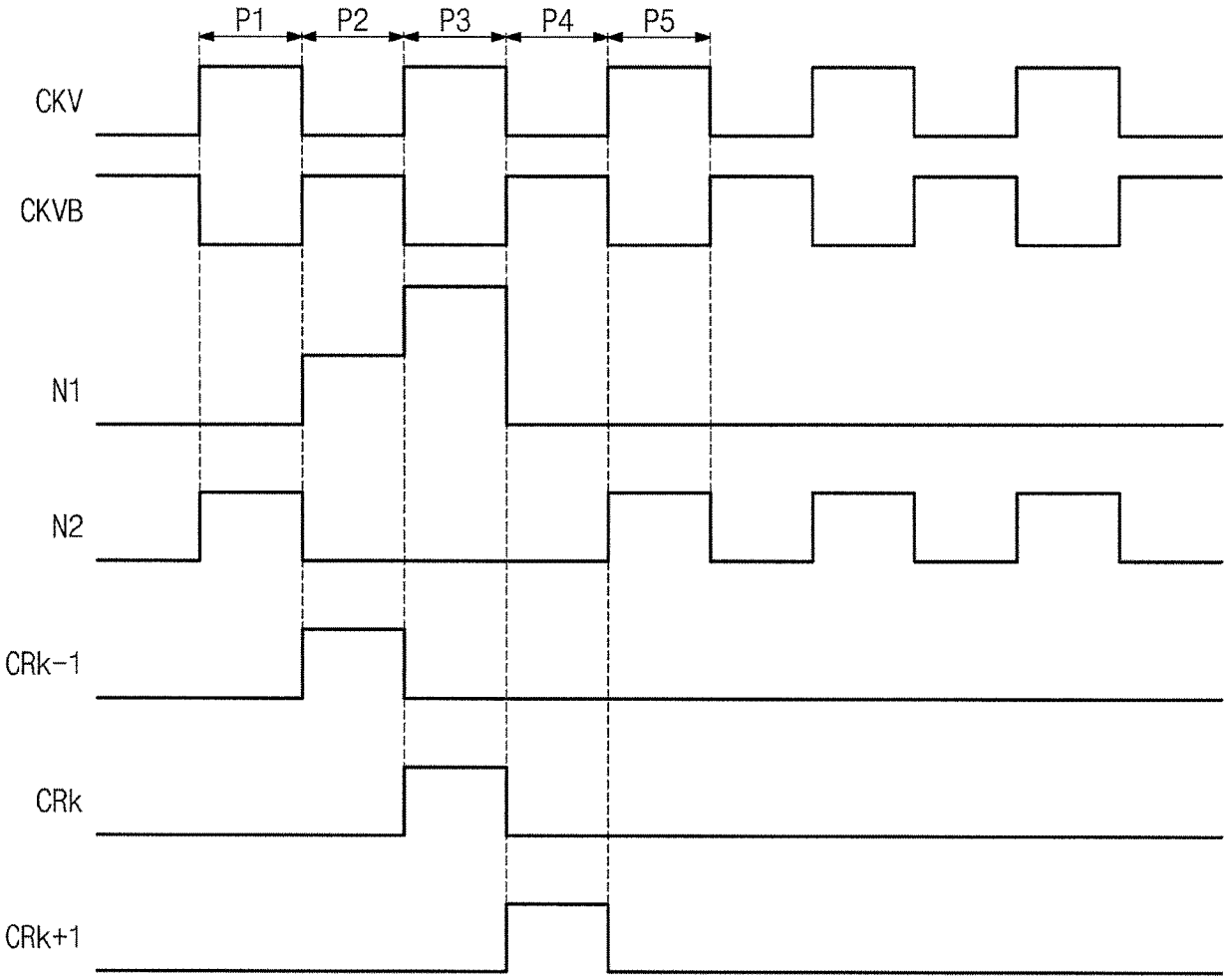
FIG. 7 illustrates an embodiment of a timing diagram of the driving stage.

FIG. 7 illustrates an embodiment of a timing diagram for controlling operation of the driving stage in FIG. 6. Referring to FIGS. 6 and 7, in the first section P1, the first clock signal CKV shifts to a high level and the second clock signal CKVB shifts to a low level. In a second section P2, the first clock signal CKV shifts to a low level, the second clock signal CKVB shifts to a high level, and the (k−1)th carry signal CRk−1 shifts to a high level. When the input transistor TR1 is turned on based on the high-level (k−1)th carry signal CRk−1 and the switching transistor TR15 is turned on based on the high-level second clock signal CKVB, the first node N1 is pre-charged to a predetermined voltage level (e.g., a voltage level corresponding to the (k−1)th carry signal CRk−1).

When the first clock signal CKV shifts to a high level in a third section P3, as the first output transistor TR2 is turned on, a signal level of the first node N1 is boosted-up by the first capacitor C1 and the k-th gate signal Gk output to the gate output terminal OUT shifts to a high level. Moreover, when the first clock signal CKV shifts to a high level, as the second output transistor TR3 is turned on, the k-th carry signal CRk output to the carry output terminal CR shifts to a high level. At this point, as the third hold transistor TR6 and the fourth hold transistor TR7 are turned on by the high-level k-th carry signal CRk, the second node N2 maintains (or holds) a level of the second ground voltage VSS2. Moreover, in the third section P3, as the second clock signal CKVB shifts to a low level, the switching transistor TR15 is turned off.

In a fourth section P4, when the first clock signal CKV shifts to a low level, each of the first output transistor TR2 and the second output transistor TR3 is turned off. Then, when the (k+1)th carry signal CRk+1 from the (k+1)th stage SRCk+1 shifts to a high level, the first pull down transistor TR8, the third pull down transistor TR10, and the fifth pull down transistor TR12 are turned on, the first node N1 and the k-th carry signal CRk are discharged as the second ground voltage VSS2, and the k-th gate signal Gk is discharged as the first ground voltage VSS1.

In a fifth section P5, when the first clock signal CKV shifts to a high level, since the first hold transistor TR4 and the second hold transistor TR5 in the discharge hold circuit 240 are turned on, the high-level first clock signal CKV is delivered to the second node N2. Since the second pull down transistor TR9 and the fourth pull down transistor TR11 are turned on while the second node N2 is in a high level, the k-th gate signal Gk may be maintained as the first ground voltage VSS1 and the k-th carry signal CRk may be maintained as the second ground voltage VSS2.

After the k-th gate signal Gk and the k-th carry signal CRk shift from a high level to a low level in the frame section Ft in FIG. 2, until the k-th gate signal Gk and the k-th carry signal CRk shift to a high level again in the next frame section Ft+1, as the fourth section P4 and the fifth section P5 shown in FIG. 7 are repeated, the k-th gate signal Gk and the k-th carry signal CRk may maintain a low level.

Figure 8:
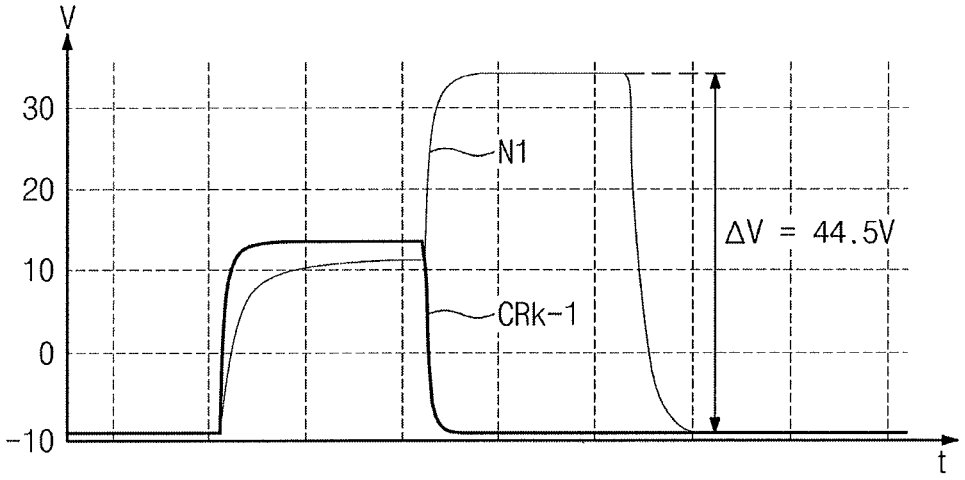
FIG. 8 illustrates an embodiment of waveforms for the driving stage.

FIG. 8 illustrates an embodiment of waveforms of a (k−1)th carry signal applied to a first input terminal in FIG. 6 and a signal of a first node. Referring to FIGS. 6, 7, and 8, the (k−1)th carry signal CRk−1 shifts from a high level to a low level in the third section P3. During the third section P3, the (k−1)th carry signal CRk−1 is provided to the first electrode (or the drain electrode) of the input transistor TR1. When it is assumed that the switching transistor TR15 in the switching circuit 260 is in a turn-on state, a voltage level of the first node N1 is provided to the second electrode (or the source electrode) of the input transistor TR1. The voltage level of the first node N1 is (VON−Vth)+(β*(VON−VSS2)). In this equation, VON is a voltage of a high level section of the (k−1)th carry signal CRk−1, Vth is a threshold voltage of the input transistor TR1, β is a ratio (C1/Ctotal) of a capacitance of the capacitor C1 to the entire capacitance Ctotal of the stage SRCk, and VSS2 is a second ground voltage VSS2.

For example, when a voltage level of the (k−1)th carry signal CRk−1 is −10 V and a voltage level of the first node N1 is +34.5 V, a voltage difference between the first electrode and the second electrode of the input transistor TR1 is 44.5 V. When a voltage difference between drain-source electrodes of the input transistor TR1 is above a predetermined level, the input transistor TR1 may deteriorate by high voltage stress.

In this embodiment, when a voltage of the first node N1 is boosted to a high voltage level (e.g., +34.5V) during the third section P3, the switching transistor TR15 is turned off since the second clock signal CKVB is in a low level. Therefore, while the (k−1)th carry signal CRk−1 provided to the first electrode of the input transistor TR1 is the second ground voltage VSS2 in the third section P3, the second electrode of the input transistor T1 has a voltage level (e.g., 14 V) of the (k−1)th carry signal CRk−1 in the second section P2. As a voltage difference between the first electrode and the second electrode of the input transistor TR1 is reduced during the third section P3, deterioration of the input transistor TR1 may be prevented. Additionally, the input transistor TR1 is fully turned off since a voltage difference VGS between the gate and source of the input transistor TR1 is (VSS2−VON−Vth) during the third section. Therefore, as a leakage current flowing through the input transistor TR1 is reduced, deterioration of the input transistor TR1 due to hot carrier effect (HCE) may be prevented.

Figure 9:
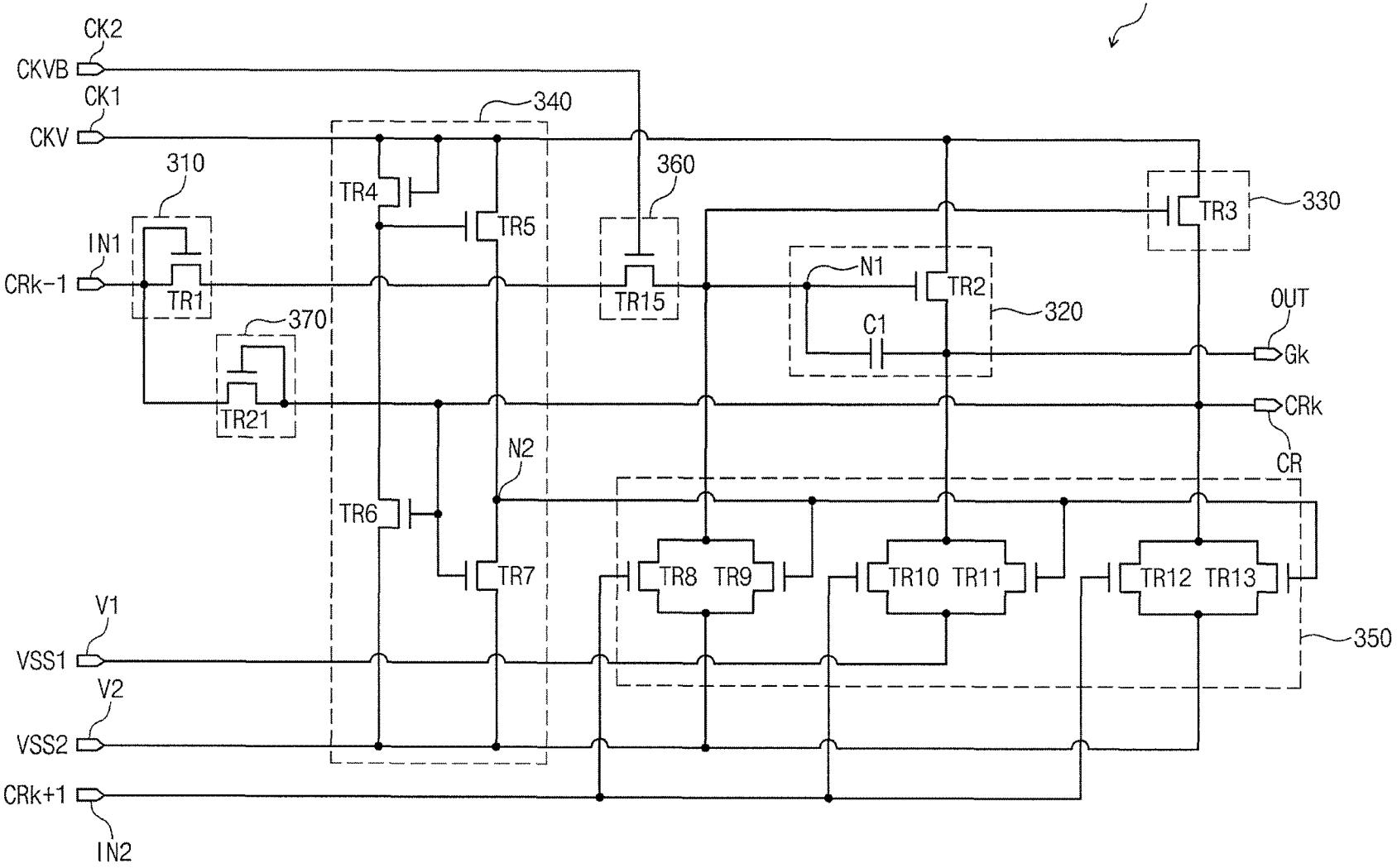
FIG. 9 illustrates another embodiment of a driving stage.

FIG. 9 illustrates another embodiment of a driving stage ASRCk corresponding to a k-th driving stage SRCk (k is a positive integer greater than 1) among the driving stages SRC1 to SRCn in FIG. 5. Each of the driving stages SRC1 to SRCn in FIG. 5 may have the same circuit as the k-th driving stage ASRCk in FIG. 9. A k-th driving stage ASRCk in FIG. 9 may receive a first clock signal CKV through a first clock terminal CK1 and receive a second clock signal CKVb through a second clock terminal CK2. In one embodiment, the k-th driving stage ASRCk may receive the second clock signal CKVB through the first clock terminal CK1 and receive the first clock signal CKV through the second clock terminal CK2.

Referring to FIG. 9, the k-th driving stage ASRCk includes an input circuit 310, a first output circuit 320, a second output circuit 330, a discharge hold circuit 340, a pull down circuit 350, a switching circuit 360, and a carry feedback circuit 370. Transistors TR1 to TR13 and TR15 in the k-th driving stage ASRCk in FIG. 9 may have the same configuration as the transistors TR1 to TR13 and TR15 in the k-th driving stage SRCk in FIG. 6.

The carry feedback circuit 370 in FIG. 9 feeds back the k-th carry signal CRk as the (k−1)th carry signal CRk−1. The carry feedback circuit 370 includes a feedback transistor TR21. The feedback transistor TR21 includes a first electrode connected to the carry output terminal CR for outputting the k-th carry signal CRk, a second electrode connected to the first input terminal IN1, and a gate electrode connected to the carry output terminal CR.

Referring to FIGS. 7 and 9, when the (k−1)th carry signal CRk−1 shifts from a high level to a low level in the third section P3 and the switching transistor TR15 is turned off based on the second clock signal CKVB in a low level, the k-th carry signal CRk in a high level may be fed back to the first input terminal IN1 for receiving the (k−1)th carry signal CRk−1.

Since the first electrode (e.g., the drain electrode) of the input transistor TR1 is a voltage level VON of the k-th carry signal CRk and a voltage level of the second electrode (e.g., the source electrode) is (VON-Vth), a voltage difference between the drain and source electrodes of the input transistor T1 may be further reduced or minimized. In such a way, deterioration of the input transistor TR1 may be prevented as a voltage difference between the first electrode and the second electrode of the input transistor TR1 is reduced during the third section P3.

Figure 10:
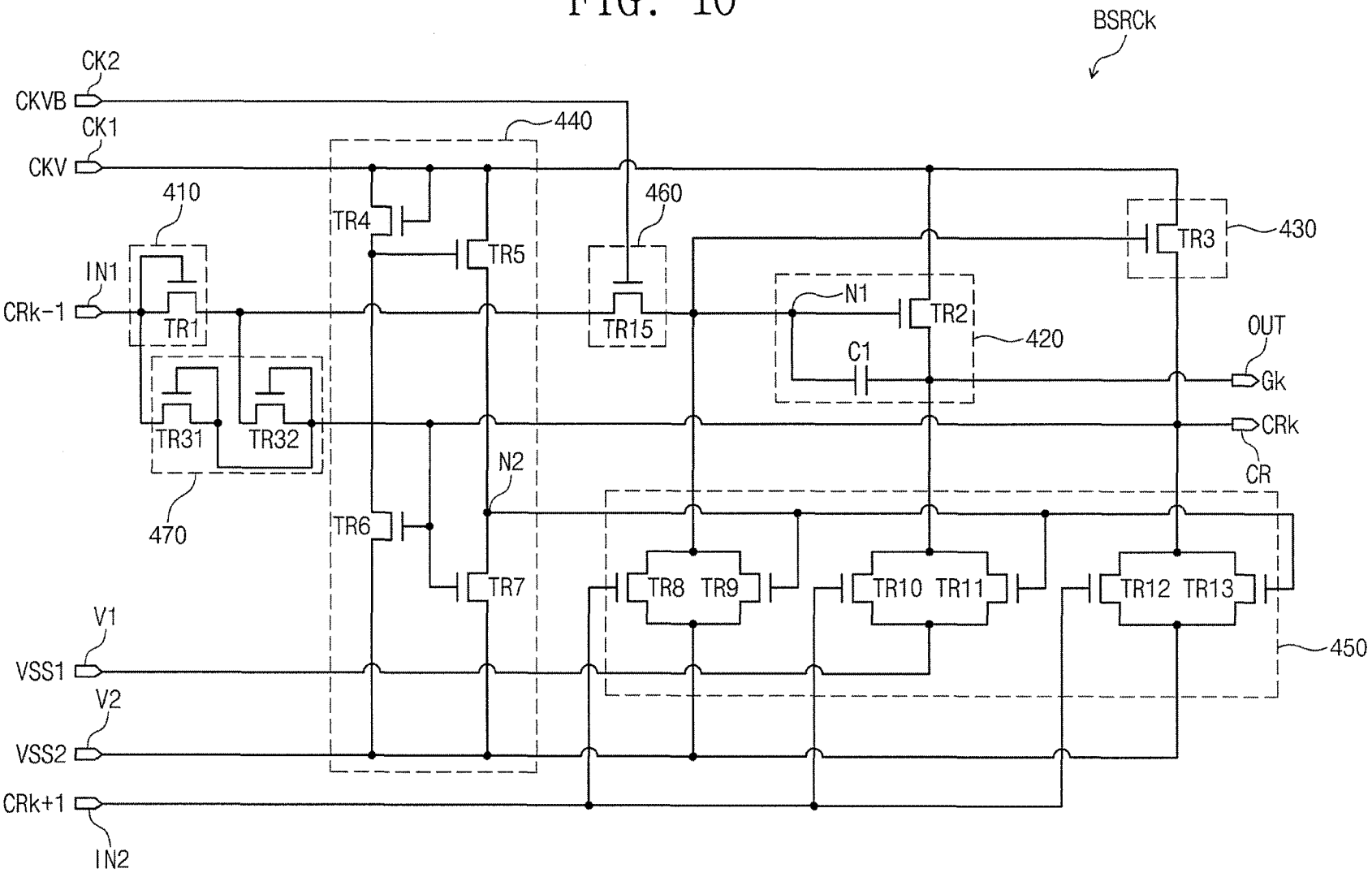
FIG. 10 illustrates another embodiment of a driving stage.

FIG. 10 illustrates another embodiment of a driving stage BSRCk corresponding to a k-th driving stage SRCk (k is a positive integer greater than 1) among the driving stages SRC1 to SRCn in FIG. 5. Each of the driving stages SRC1 to SRCn in FIG. 5 may have the same circuit as the k-th driving stage BSRCk in FIG. 10. A driving stage BSRCk in FIG. 10 may receive a first clock signal CKV through a first clock terminal CK1 and may receive a second clock signal CKVb through a second clock terminal CK2. In one embodiment, driving stage BSRCk may receive the second clock signal CKVB through the first clock terminal CK1 and may receive the first clock signal CKV through the second clock terminal CK2.

Referring to FIG. 10, the k-th driving stage BSRCk includes an input circuit 410, a first output circuit 420, a second output circuit 430, a discharge hold circuit 440, a pull down circuit 450, a switching circuit 460, and a carry feedback circuit 470. Transistors TR1 to TR13 and TR15 in the k-th driving stage BSRCk in FIG. 10 may have the same configuration as the transistors TR1 to TR13 and TR15 in the k-th driving stage SRCk in FIG. 6.

The carry feedback circuit 470 in FIG. 10 feeds back the k-th carry signal CRk to each of the first electrode and the second electrode of the input transistor T1. The carry feedback circuit 470 may include a first feedback transistor TR31 and a second feedback transistor TR32. The first feedback transistor TR31 includes a first electrode connected to the carry output terminal CR for outputting the k-th carry signal CRk, a second electrode connected to the first electrode of the input transistor TR1, and a gate electrode connected to the carry output terminal CR. The second feedback transistor TR32 includes a first electrode connected to the carry output terminal CR for outputting the k-th carry signal CRk, a second electrode connected to the second electrode of the input transistor TR1, and a gate electrode connected to the carry output terminal CR.

Referring to FIGS. 7 and 10, when the (k−1)th carry signal CRk−1 shifts from a high level to a low level in the third section P3 and the switching transistor TR15 is turned off based on the second clock signal CKVB in a low level, the k-th carry signal CRk in a high level may be fed back to the first electrode and the second electrode of the input transistor TR1.

Since voltages levels of the first electrode (e.g., the drain electrode) and the second electrode (e.g., the source electrode) of the input transistor TR1 are maintained as similar voltage levels during the third section P3, a voltage difference between the drain and source electrodes of the input transistor T1 may be further reduced or minimized. In such a way, deterioration of the input transistor TR1 may be reduced or prevented as a voltage difference between the first electrode and the second electrode of the input transistor TR1 is reduced during the third section P3.

In accordance with one or more of the aforementioned embodiments, a gate driving circuit is provided that may prevent deterioration of a transistor by reducing a voltage difference between a drain electrode and a source electrode of the transistor. Therefore, reliability deterioration of a gate driving circuit and a display device including the same may be reduced or prevented.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A gate driving circuit, comprising:

a plurality of stages to provide gate signals to gate lines of a display panel, wherein a k-th stage (k being a natural number greater than or equal to 2) of the plurality of stages includes:

an input circuit to receive a (k−1)th carry signal from a (k−1)th stage;

a first output circuit to output a first clock signal as a k-th gate signal based on a signal of a first node;

a second output circuit to output the first clock signal as a k-th carry signal based on the signal of the first node;

a discharge hold circuit to deliver the first clock signal to a second node based on the first clock signal and discharge the second node as a second voltage based on the k-th carry signal;

a pull down circuit to discharge the k-th gate signal as a first voltage based on a signal of the second node and a (k+1)th carry signal from a (k+1)th stage and discharge the first node and the k-th carry signal as the second voltage; and a switching circuit, connected between the input circuit and the first node, to deliver the (k−1)th carry signal received through the input circuit to the first node based on a second clock signal, wherein the switching circuit electrically disconnects the input circuit from the first node when the signal of the first node has a two-times step-up voltage level.

2. The gate driving circuit as claimed in claim 1, wherein the first clock signal and the second clock signal have different phases.

3. The gate driving circuit as claimed in claim 2, wherein the switching circuit includes a switching transistor including a first electrode connected to the input circuit, a second electrode connected to the first node, and a control electrode connected to a second clock terminal to receive the second clock signal.

4. The gate driving circuit as claimed in claim 3, wherein the input circuit includes an input transistor including a first electrode connected to a first input terminal for receiving the (k−1)th carry signal, a second electrode connected to the first electrode of the switching transistor, and a control electrode connected to the first input terminal.

5. The gate driving circuit as claimed in claim 1, wherein the discharge hold circuit includes:

a first hold transistor including a first electrode connected to a first clock terminal to receive the first clock signal, a second electrode, and a gate electrode connected to the first clock terminal;

a second hold transistor including a first electrode connected to the first clock terminal, a second electrode connected to the second node, and a gate electrode connected to the second electrode of the first hold transistor;

a third hold transistor including a first electrode connected to the second electrode of the first hold transistor, a second electrode connected to a second terminal to receive the second voltage, and a gate electrode connected to a carry output terminal to output the k-th carry signal; and a fourth hold transistor including a first electrode connected to the second node, a second electrode connected to the second terminal, and a gate electrode connected to the carry output terminal.

6. A gate driving circuit, comprising:

a plurality of stages including a k-th stage (k is a positive integer greater than 1), the k-th stage including:

an input circuit to receive a (k−1)th carry signal from a (k−1)th stage;

a first output circuit to output a first clock signal as a k-th gate signal based on a signal of a first node;

a second output circuit to output the first clock signal as a k-th carry signal based on the signal of the first node;

a discharge hold circuit to deliver the first clock signal to a second node based on the first clock signal and discharge the second node as a second voltage based on the k-th carry signal;

a pull down circuit to discharge the k-th gate signal as a first voltage based on a signal of the second node and a (k+1)th carry signal from a (k+1)th stage and discharge the first node and the k-th carry signal as the second voltage;

a switching circuit, connected between the input circuit and the first node, to deliver the (k−1)th carry signal received through the input circuit to the first node based on a second clock signal; and a carry feedback circuit to feed back the k-th carry signal as the (k−1)th carry signal, wherein the switching circuit electrically disconnects the input circuit from the first node when the signal of the first node has a two-time step-up voltage level.

7. The gate driving circuit as claimed in claim 6, wherein the first clock signal and the second clock signal have different phases.

8. The gate driving circuit as claimed in claim 7, wherein the switching circuit includes a switching transistor including a first electrode connected to the input circuit, a second electrode connected to the first node, and a control electrode connected to a second clock terminal to receive the second clock signal.

9. The gate driving circuit as claimed in claim 8, wherein the input circuit includes an input transistor including a first electrode connected to a first input terminal to receive the (k−1)th carry signal, a second electrode connected to the first electrode of the switching transistor, and a control electrode connected to the first input terminal.

10. The gate driving circuit as claimed in claim 6, wherein the carry feedback circuit includes a first electrode connected to a carry output terminal to output the k-th carry signal, a second electrode connected to a first input terminal to receive the (k−1)th carry signal, and a gate electrode connected to the carry output terminal.

11. The gate driving circuit as claimed in claim 6, wherein the carry feedback circuit is to feed back the k-th carry signal to a connection node of the input circuit and the switching circuit.

12. The gate driving circuit as claimed in claim 11, wherein the carry feedback circuit includes:

a first feedback transistor including a first electrode connected to a carry output terminal to output the k-th carry signal, a second electrode connected to a first input terminal to receive the (k−1)th carry signal, and a gate electrode connected to the carry output terminal; and a second feedback transistor including a first electrode connected to the carry output terminal, a second electrode connected to a connection node of the input circuit and the switching circuit, and a gate electrode connected to the carry output terminal.

13. A display device, comprising:

a display panel including a plurality of pixels connected to a plurality of gate lines and a plurality of data lines, respectively;

a gate driving circuit including a plurality of stages to output gate signals to the plurality of gate lines; and a data driving circuit to drive the plurality of data lines, wherein a k-th stage (k is a positive integer greater than 1) among the plurality of stages in the gate driving circuit includes:

an input circuit to receive a (k−1)th carry signal from a (k−1)th stage;

a first output circuit to output a first clock signal as a k-th gate signal based on a signal of a first node;

a second output circuit to output the first clock signal as a k-th carry signal based on the signal of the first node;

a discharge hold circuit to deliver the first clock signal to a second node based on the first clock signal and discharge the second node as a second voltage based on the k-th carry signal;

a pull down circuit to discharge the k-th gate signal as a first voltage based on a signal of the second node and a (k+1)th carry signal from a (k+1)th stage and to discharge the first node and the k-th carry signal as the second voltage; and a switching circuit, connected between the input circuit and the first node, to deliver the (k−1)th carry signal received through the input circuit to the first node based on a second clock signal, wherein the switching circuit electrically disconnects the input circuit from the first node when the signal of the first node has a two-times step-up voltage level.

14. The display device as claimed in claim 13, wherein the first clock signal and the second clock signal have different phases.

15. The display device as claimed in claim 14, wherein the switching circuit includes a switching transistor including a first electrode connected to the input circuit, a second electrode connected to the first node, and a control electrode connected to a second clock terminal to receive the second clock signal.

* * * * *